US005445647A

United States Patent [19]

Choy

[11] Patent Number: 5,445,647

[45] Date of Patent: * Aug. 29, 1995

[54] SPINAL ACUPRESSURE DEVICE

[76] Inventor: Daniel S. J. Choy, 892 River Bank Rd., Stamford, Conn. 06903

[ * ] Notice: The portion of the term of this patent subsequent to Mar. 1, 2011 has been disclaimed.

[21] Appl. No.: 279,825

[22] Filed: Jul. 25, 1994

Related U.S. Application Data

[63] Continuation of Ser. No. 179,913, Jan. 11, 1994, abandoned, which is a continuation of Ser. No. 676,745, Mar. 28, 1991, Pat. No. 5,290,307.

[51] Int. Cl.[6] ..... A61H 15/00

[52] U.S. Cl. ..... 606/204; 128/101.1

[58] Field of Search ..... 606/204; 128/101.1; 601/132, 134, 135

[56] References Cited

U.S. PATENT DOCUMENTS 4,210,134 7/1980 Okazaki et al. ..... 128/60 X 4,233,966 11/1980 Takahashi ..... 128/67

4,411,258 10/1983 Pujals ..... 606/204 X

*Primary Examiner*—Michael H. Thaler

*Attorney, Agent, or Firm*—Schweitzer Cornman & Gross

[57] ABSTRACT

An acupressure belt for the treatment of lower back pain is formed of a central fabric panel to which opposed elastic panels are affixed. The elastic panels terminate in a pair of end panels which may be joined together to retain the belt about the torso of the wearer. Located on the inner surface of the central panel is a plurality of acupressure-applying protrusions, each of which are individually positionable on the panel. The protrusions are positioned to apply pressure to the $L_1$–$L_4$ acupressure points associated with the lower spine. A pair of overlapping elastic panels are further affixed to the opposed sides of the control panel about the torso with the protrusions in position, whereby acupressure is generated and applied for the relief of lower back pain.

3 Claims, 3 Drawing Sheets

SPINAL ACUPRESSURE DEVICE

This is a continuation application of U.S. Application Ser. No. 08/179,913, filed on Jan. 11, 1994, now abandoned which is a continuation application of U.S. Ser. No. 07/767,745, filed on Mar. 28, 1991, now U.S. Pat. No. 5,290,307 of Mar. 1, 1994.

The present invention relates to a medical device and, in particular, to a device intended to alleviate lower back pain in a non-invasive manner.

BACKGROUND OF THE INVENTION

The oriental teachings of a plurality of target sites in the human body for the treatment of pain and certain ailments has been established in literature and practice for some three thousand years. These sites, some 400 in number, are located on 12 paired and 2 unpaired "meridians". The science of acupuncture, utilizing a series of thin needles inserted through the skin at such specific sites, provides a methodology for the treatment of ailments associated with the meridians. Current medical thinking suggests that the insertion of the acupuncture needles stimulates the production and release of endorphins, which serve to moderate or eliminate pain in surrounding areas.

For obvious reasons, there is a reluctance on the part of certain individuals to participate in an acupuncture regimen. In addition, the physical insertion of the needles and their manipulation requires great skill and clearly is not a therapy which can be provided by the patient himself. Related acupressure therapy, which utilizes the known acupuncture points for the application of concentrated and direct pressure on the skin surface, rather than the penetration of the skin surface by an acupuncture needle, provides an alternative therapy which can accomplish the same results in a non-invasive manner and thus may be practiced by the patient without the continued presence and supervision of an acupuncture therapist.

In order for acupressure therapy to be effective, the pressure points must be identified and contacted with precision. In addition, it may be necessary for the pressure to be applied over a continued period of time. Manual application of pressure is subject to shortcomings, especially when it is attempted by the patient himself, both because of difficulties in locating the appropriate pressure points, as well as the difficulties associated with the continuous maintenance of pressure on the points over an extended period of time.

In particular, it has been found that lower back pain of non-specific origin may be alleviated in up to approximately 80% of the time by the application of acupressure to specific acupuncture points proximate the spine in the lower back region. Because of the location of such points, it is especially difficult for manual self-application of the necessary pressure. Further, the associated points are eight in number, thus making it cumbersome, if not impossible, for the simultaneous manual application of pressure to each of the points.

It is accordingly a purpose of the present invention to provide an acupressure device adapted to simultaneously provide pressure to spinal acupuncture points for the relief of lower back pain.

A further purpose of the present invention is to provide a device able to provide acupressure to spinal acupuncture points in a manner which facilitates continuous therapy.

Yet a further purpose of the present invention is to provide such a device which may be adjusted to accommodate person-to-person variations in the location of the pressure points.

A still further purpose of the present invention is to provide a spinal acupressure device in the form of a belt having an integral closure device which allows appropriate pressure to be placed simultaneously against the eight acupressure points of the lower spine to allow acupressure therapy to be maintained thereon over an extended period of time.

BRIEF DESCRIPTION OF THE INVENTION

In accordance with the foregoing and other purposes and objects, the spinal acupressure device of the present invention comprises a belt having integral elastic portions and a fastening structure which permits the belt to be cinched tightly around the wearer. A plurality of adjustable protrusions are positioned along the interior of the belt in a manner which permits their orientation to apply simultaneous pressure against the acupressure points of the lower spine. The belt may be worn for an extended period of time, whereby acupressure is maintained against the appropriate points to provide continuous pain relief.

BRIEF DESCRIPTION OF THE DRAWINGS

A fuller understanding of the present invention will be achieved upon consideration of the following description of a preferred, but nonetheless illustrative embodiment thereof, when reviewed in association with the annexed drawings, wherein.

DETAILED DESCRIPTION OF THE INVENTION

Figure 1:
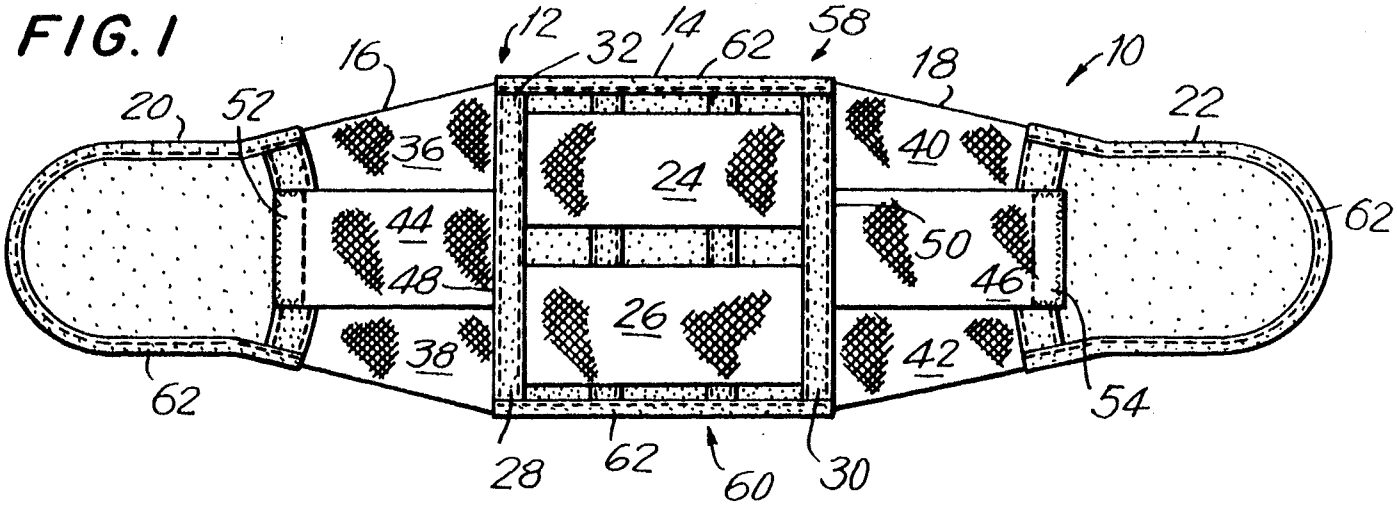
FIG. 1 is a rear elevation view of the invention, presenting the exterior of the belt.
Figure 2:
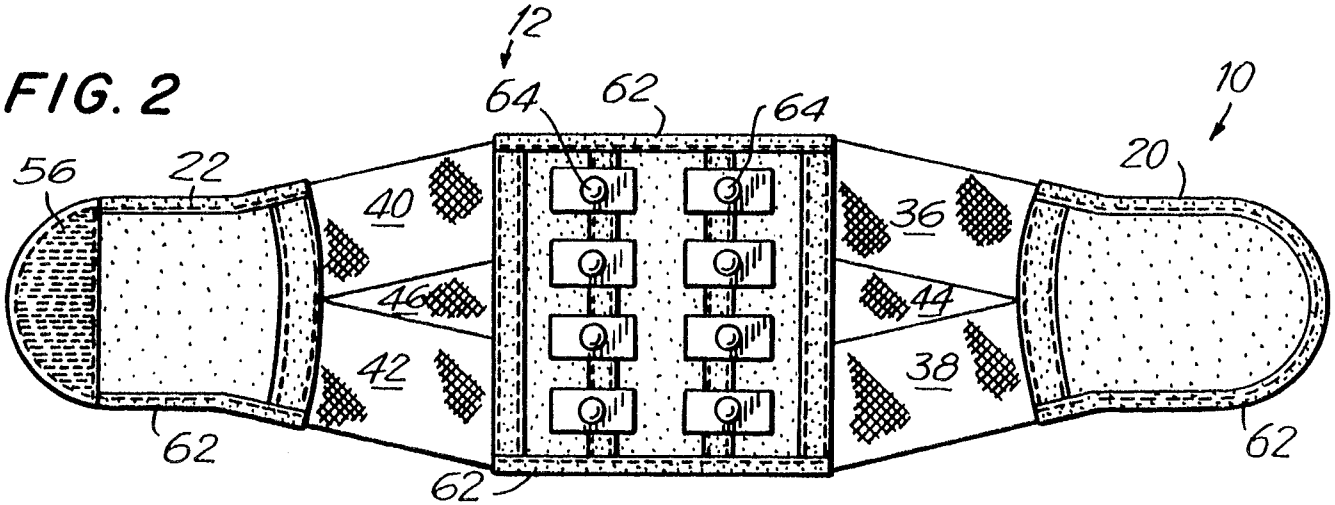
FIG. 2 is a front elevation view of the invention presenting the interior of the belt which is in contact with the skin of the wearer.

As best seen in FIGS. 1 and 2, the present invention 10 is in the form of a generally elongated belt unit 12 having a central panel area 14 joined by intermediate elastic panel portions 16, 18 to two opposed end panels 20, 22. The central panel 14 may be formed of conventional fabric materials having a relatively small amount of resiliency or stretch and having its surfaces finished in a plush pile. An inner lining of spun or woven polyester, cotton, or similar material may be provided to provide a measure of thicknesses and padding. The outer surface (see FIG. 1) is overlaid with a pair of parallel, horizontally-extending elastic bands 24, 26 affixed to the opposed vertical margins 28, 30 of the panel by appropriate fastening means, such as by sewing. The bands are affixed to the central panel such that the central panel is somewhat foreshortened horizontally when the bands are in the untensioned state, such that tension applied to the opposed ends of the belt, such as when wrapped around the torso, allow the elastic panels to stretch. Running vertically within the central panel 14 in four stitched pockets 32 are vertical stiffeners 34, best seen in FIG. 5. The stiffeners may be of thin gauge metal or resilient plastic as known in the art.

Extending outwardly in a horizontal manner from the vertical margins 28, 30 of the central panel area are the opposed elastic panel elements 16 and 18. Each of elastic panel elements 16, 18 include a pair of marginal elastic band elements 36, 38, and 40, 42, respectively, generally tapering from the width of the central panel 14 to a somewhat reduced width of the end panels 20, 22. In particular, the central panel may have a width of approximately 8 inches, with the elastic panels tapering to a width of approximately 5–5½ inches. A pair of central elastic bands 44, 46 overlie the marginal bands 36, 38, and 40, 42 on the exterior side of the unit, as best seen in FIG. 1, and have their first ends 48, 50 affixed to the vertical margins 28, 30, respectively, of central panel 14. The free distal ends of the bands 44, 46 are provided with the hook portion of complementary hook and eyelet-type of connectors, such as those sold under the trademark "Velcro", as seen at 52, 54.

The end panels 20, 22 may be formed of a similar fabric material as the central panel 14 with plush pile outer surfaces and are of generally rectangular configuration adapted to complete the encirclement of the torso of the wearer and overlap in a manner which facilitates engagement of the opposed ends of the belt. As seen in FIG. 2, the left end panel 22 is provided on its inner surface at its distal end with a panel of "Velcro"-type hook fastener elements 56 to engage the plush pile of the opposed end panel 20 when wrapped around the wearer. The exposed margins of the end panels 20, 22, as well as the upper and lower edges 58, 60 of central panel 14, may be provided with a peripheral welting 62 to improve appearance and provide a finished edge.

Figure 4:
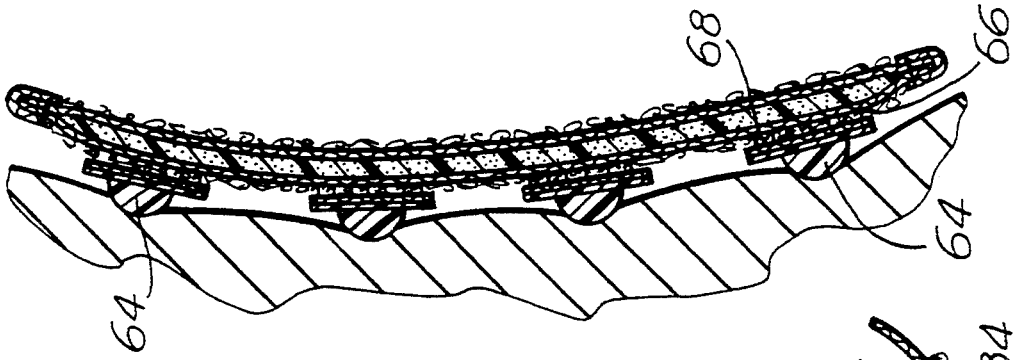
FIG. 4 is a side elevation view in section taken along line 4—4 of FIG. 3.
Figure 5:
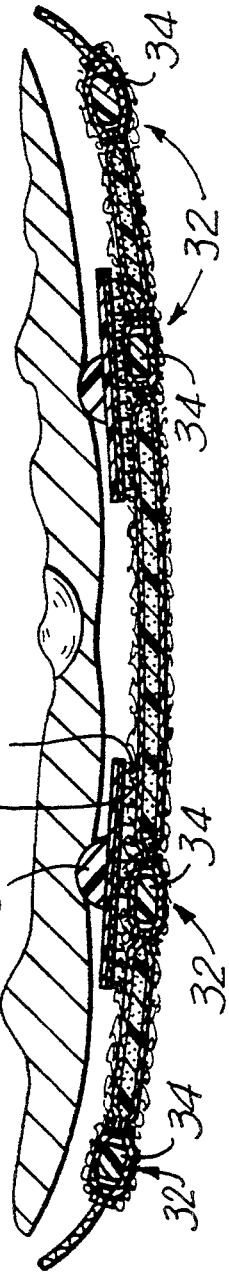
FIG. 5 is a top plan view in section taken along line 5—5 of FIG. 3.

Arrayed on the inner surface of central panel 14 are a series of button-like elements 64, as seen in FIGS. 2, 4 and 5. The buttons may be generally in the form of spherical segments, formed of nylon or other appropriate material, and may be on the order of ⅝" in diameter and ½" in height. Each of the elements may be mounted on a generally rectangular backing plate 66 of plastic or other similar material, the rearward surface of which is provided with a strip 68 of the hook portion of "Velcro" fastening material. The fastening material engages the plush fabric surface of central panel 14, and thus allows the individual positioning of each of the buttons 64 on the central panel in accordance with the invention.

Figure 3:
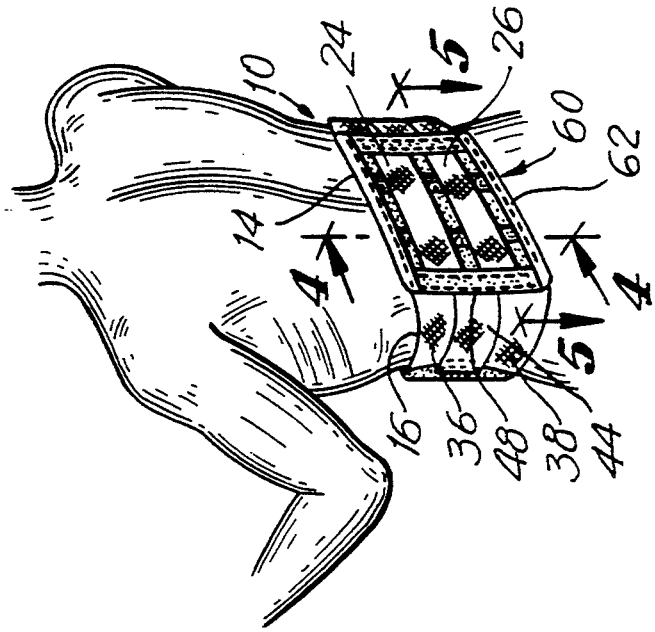
FIG. 3 is a perspective view of the invention in place on a wearer.
Figure 6:
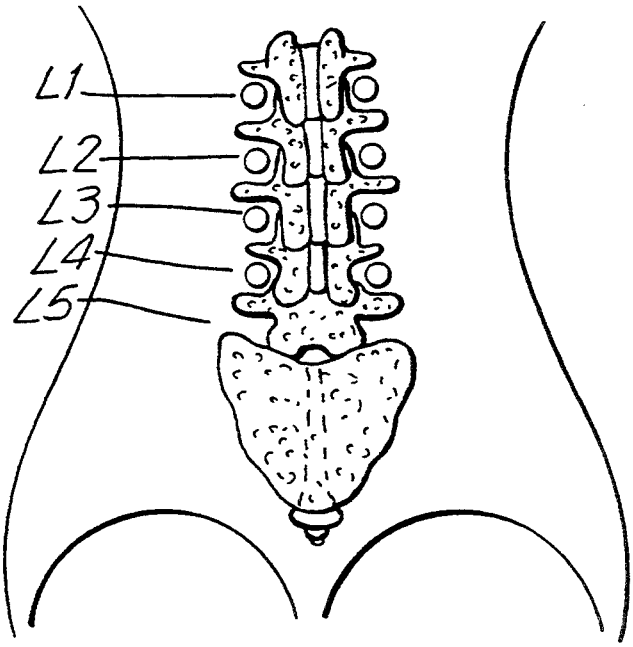
FIG. 6 is a schematicized representation of the human spine illustrating the acupressure points to which the present invention is directed.

As depicted in FIG. 6, the acupressure points to which pressure is applied by the present invention are associated with the L1–L4 spinous processes. As depicted in the Figure, the acupressure points, indicated by the circles, are approximately one inch laterally from the mid-line of the processes. When the belt is first configured for use with a patient, it may be preferable for the practitioner to specifically identify and mark on the skin of the patient, such as by washable marker, the location of the acupressure points. The belt is then positioned over the lower back, as seen in FIG. 3, the edge or the bottom margin 60 of the central panel 16 being positioned to rest just above the iliac crest. The buttons 64 are then positioned on the central panel so that they can apply pressure directly over the marked acupressure points.

The end panels 20, 22 are then overlapped and secured by engaging the hook elements section 56 of panel 20 upon the outwardly lying face of the opposed end panel 22. The elastic bands 44, 46 may then be utilized to cinch the belt as tightly as desired by engaging the hook elements 52, 54 at the ends thereof with the appropriate portion of the exposed surface of the end panels 20, 22.

The location of the end and center panels, as well as the positioning of the central panel with respect to the user's spine can be marked on the belt itself to help insure consistent repeatability of installation. The belt can subsequently be applied either with the aid of an assistant to insure the proper positioning of the buttons. Alternatively, a well motivated user can apply the belt by himself by use of a mirror. With the belt properly in place, continuous acupressure is applied to the acupuncture/acupressure points, thus providing significant alleviation of lower back pain radiating from the general area.

I claim:

1. A spinal acupressure device, comprising a belt defined by a central panel adapted to be positionable against the lower back of the wearer overlying the L1–L4 spinous processes; elastic band elements affixed at their first ends to the opposed vertical margins of said central panel and terminating at their second ends in a pair of mutually-engageable end panels and a pair of elastic cinch elements having their first ends affixed to the opposed vertical margins of said central panel and having engagement means at their second ends thereof for retaining said cinch elements in a stretched and extended configuration when the belt is about the wearer, and a plurality of eight pressure-point generating means removably mounted to said central panels for applying acupressure to the L1 through L4 acupressure points of the wearer, each of said pressure-point generating means comprising a hemispheric projection.

2. The device of claim 1, wherein said hemispheric projections are each mounted to a separate first element of complementary hook-and-eye-type fasteners, the second, complementary portion being located upon the inner surface of said central panel.

3. The device of claim 2, wherein said second portion of said fasteners comprises the inner/surface of said central panel.

* * * * *